US007513609B2

(12) United States Patent
Katayama

(10) Patent No.: US 7,513,609 B2
(45) Date of Patent: Apr. 7, 2009

(54) INK-JET PRINTER HEAD INCLUDING MEASUREMENT ELECTRODE FOR MEASURING CAPACITANCE WITH COMMON ELECTRODE

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 440 days.

(21) Appl. No.: 11/391,467

(22) Filed: Mar. 29, 2006

(65) Prior Publication Data

US 2006/0221142 A1 Oct. 5, 2006

(30) Foreign Application Priority Data

Mar. 30, 2005 (JP) ..... 2005-099519
Apr. 6, 2005 (JP) ..... 2005-110283

(51) Int. Cl.
*B41J 2/045* (2006.01)

(52) U.S. Cl. ..... 347/68; 347/15

(58) Field of Classification Search ..... 347/9, 347/11, 14, 19, 68–71, 15
See application file for complete search history.

(56) References Cited

U.S. PATENT DOCUMENTS 6,786,572 B2 * 9/2004 Imanaka et al. ..... 347/50
6,993,812 B2 * 2/2006 Takahashi ..... 29/25.35

FOREIGN PATENT DOCUMENTS

JP 1993206535 A 8/1993
JP 2004082542 A 3/2004

* cited by examiner

*Primary Examiner*—Juanita D Stephens
(74) *Attorney, Agent, or Firm*—Baker Botts L.L.P.

(57) ABSTRACT

A measurement electrode for capacitance measurement is disposed so as to be opposed to a common electrode with a second and a third piezoelectric plates in between and to be opposed to all ink pressurizing chambers with a first piezoelectric plate in between. The capacitance of the piezoelectric plate disposed between the common electrode and the measurement electrode is measured with a larger area, and from the measured capacitance, the temperature of the piezoelectric plate is calculated based on the capacitance-temperature characteristic of the piezoelectric plate. In order to generate a pressure suitable for the ink viscosity that changes according to the temperature, the change in the overall temperature of the printer head that changes according to the status of use of the printer is accurately measured.

16 Claims, 13 Drawing Sheets

FIG. 8

| TEMPERATURE [℃] | APPLIED VOLTAGE [V] | APPLIED WAVEFORM |
|---|---|---|
| ~ 8 | 28.0 | (A) |
| 8~10 | 27.6 | |
| 10~12 | 26.8 | |
| 12~14 | 26.4 | |
| 14~16 | 25.6 | |
| 16~18 | 25.2 | |
| 18~20 | 24.4 | (B) |
| 20~22 | 24.1 | |
| 22~24 | 23.4 | |
| 24~26 | 23.0 | |
| 26~28 | 22.3 | |
| 28~30 | 22.0 | |
| 30~32 | 21.3 | |
| 32~34 | 21.0 | |
| 34~36 | 20.7 | (C) |
| 36~38 | 20.1 | |
| 38~40 | 19.8 | |
| 40~42 | 19.5 | |
| 42~44 | 19.2 | |
| 44~46 | 18.9 | |
| 46~ | 18.6 | |

INK-JET PRINTER HEAD INCLUDING MEASUREMENT ELECTRODE FOR MEASURING CAPACITANCE WITH COMMON ELECTRODE

CROSS-REFERENCE TO RELATED APPLICATIONS

This Nonprovisional application claims priority under 35 U.S.C. §119(a) on Patent Applications No. 2005-099519 filed in Japan on Mar. 30, 2005 and No. 2005-110283 filed in Japan on Apr. 6, 2005, the entire contents of which are hereby incorporated by reference.

BACKGROUND

The present invention relates to a printer head mounted on a printer that prints characters and images by the ink-jet printing method.

Ink-jet printers that print characters and images form characters and images with minute drops of ink. The drops of ink are jetted from minute nozzles provided on the printer head. Typical ink jetting methods include the bubble jet(R) method and the piezoelectric method. According to the bubble jet(R) method, ink is heated so as to bubble, and by using the bubbles generated at this time, ink is jetted. According to the piezoelectric method, a piezoelectric plate is deformed, and by the pressure caused in the ink flow path at this time, ink is jetted.

The viscosity of the ink used for ink-jet printers largely changes according to the ink temperature. For example, immediately after the printer is turned on, the ink temperature is low, and the ink viscosity is high. For this reason, in piezoelectric ink-jet printers, the voltage applied to the piezoelectric plate is varied according to the ink temperature. For example, when the ink temperature is low, by applying a high voltage to the piezoelectric plate, the pressure for jetting ink is increased to thereby enable ink of high viscosity to be jetted with reliability, and when the ink temperature is high, by decreasing the pressure, ink of low viscosity is prevented from being jetted in large amount to cause a smear.

However, since it is difficult to measure the temperature of the ink itself, in conventional printers, a thermistor is disposed on the circuit board where a driving circuit for driving the printer head and the like are disposed, the temperature is measured by the change of the resistance of the thermistor, and the pressure applied to the piezoelectric plate is determined according to the change of the temperature. However, in the case of the temperature measurement by the conventional printers, since the distance between the printer head having the nozzles for jetting ink and the piezoelectric plate and the circuit board that performs the temperature measurement is long, it takes time for the change of the printer head temperature to be transmitted to the circuit board, and the ink temperature cannot be accurately measured, so that the optimum pressure cannot be applied to the piezoelectric plate.

Japanese Patent Application Laid-Open No. 2004-82542 proposes a printer head having a plurality of laminated piezoelectric plates, a plurality of individual electrodes disposed on the piezoelectric plates, a common electrode opposed to all the individual electrodes with the piezoelectric plates in between, and sensor electrodes disposed so as to be opposed to the common electrode with the piezoelectric plates in between and to correspond to each individual electrode. The capacitance of the piezoelectric plates between the common electrode and the sensor electrodes is measured, and from the obtained capacitance, the temperature is calculated.

SUMMARY

According to the printer head described in Japanese Patent Application Laid-Open No. 2004-82542, paying attention to the fact that the variations in the temperature of the part of the piezoelectric plates displaced by the application of the voltage varies the amount of displacement of the piezoelectric plate, in order to reduce the variations in the amount of ink jetted from a plurality of nozzles provided, the capacitance of the piezoelectric plates is measured and the temperature is calculated. For this reason, it is necessary to dispose the sensor electrode so as to correspond to each individual electrode and an area for wiring to each sensor electrode is required of the printer head, so that the size of the printer head is increased. In addition, since the area of the sensor electrodes is small, the measurement accuracy of the temperature obtained from the capacitance is low.

The temperature difference among the nozzles, which spreads to surroundings through the piezoelectric plates, is hardly large enough for the human eye to recognize as a printing result. However, since a difference of several to several tens of degrees centigrade is caused between the printer head temperature when the printer is turned on and the printer head temperature after the printer is used for a long time, the ink viscosity largely changes, which significantly affects the printing result. For example, immediately after the printer is turned on, since the ink temperature is low and the ink viscosity is high, a high pressure is caused to jet ink, and the ink temperature increases as the printer is continuously used. However, because of the problem of the measurement accuracy of the temperature obtained from the capacitance, variations are caused in the temperature measurement. When the measured temperature is lower than the actual temperature, a high pressure is applied to ink of low viscosity and ink of an amount larger than the desired amount is jetted, so that a smear is caused in the printed characters or images. For this reason, from the viewpoint of ensuring the printing quality, it is desired to more accurately measure the change in the overall temperature of the printer head that varies according to the status of use of the printer.

In addition, since the piezoelectric plates are fired at a temperature of as high as approximately 1000 degrees centigrade in the manufacturing process of the printer head, a stress is caused because of the difference in thermal expansion coefficient between the piezoelectric plates and the electrodes disposed between the piezoelectric plates, so that depending on the lamination form of the piezoelectric plates and the electrodes, distortion or the like can occur on the printer head. For this reason, it is desired to suppress the occurrence of the distortion of the printer head due to the difference in thermal expansion coefficient to thereby reduce the rate of occurrence of defects in the manufacturing process.

An object is to provide an ink-jet printer head having a plurality of piezoelectric plates laminated on a board where a plurality of ink pressurizing chambers are formed and a common electrode and a plurality of individual electrodes disposed on the piezoelectric plates, wherein by disposing a measurement electrode for capacitance measurement so as to be opposed to the ink pressurizing chambers, the capacitance of the piezoelectric plates between the common electrode and the measurement electrode can be measured with a large area and the change in the overall temperature of the printer head that varies according to the status of use of the printer can be accurately measured.

Another object is to provide a piezoelectric actuator having a plurality of laminated piezoelectric plates and a common electrode and a plurality of individual electrodes disposed on the piezoelectric plates, wherein by disposing a measurement electrode for capacitance measurement over a plurality of displacement portions, the capacitance of the piezoelectric plates between the common electrode and the measurement electrode can be measured with a large area.

In an ink-jet printer head provided with: a board where a plurality of ink pressurizing chambers are formed; a plurality of piezoelectric plates laminated on the board; a common electrode and a plurality of individual electrodes that are opposed to each other with the piezoelectric plates in between in which the common electrode is disposed over the ink pressurizing chambers and the individual electrodes are disposed so as to correspond to the ink pressurizing chambers respectively, a measurement electrode is provided that is opposed to the common electrode with the piezoelectric plates in between and measures capacitance with the common electrode, and the measurement electrode is disposed so as to be opposed to the ink pressurizing chambers.

In this ink-jet printer head, by disposing the measurement electrode for capacitance measurement so as to be opposed to the ink pressurizing chambers, the capacitance of the piezoelectric plate between the common electrode and the measurement electrode can be measured with a large area, and by increasing the measured capacitance, the influence of the measurement error can be reduced. Consequently, the temperature can be accurately measured. Moreover, since the overall temperature of the printer head can be measured, a pressure suitable for the ink temperature that changes according to the status of use such as immediately after the printer is turned on or after the printer is continuously used. Moreover, since the increase in the wiring area for the measurement electrode can be suppressed, the printer head can be prevented from increasing in size.

In a piezoelectric actuator having a plurality of displacement portions provided with: a plurality of laminated piezoelectric plates; a common electrode and a plurality of individual electrodes that are opposed to each other with the piezoelectric plates in between in which the common electrode is disposed over the displacement portions and the individual electrodes are disposed so as to correspond to the displacement portions respectively, a measurement electrode is provided that is opposed to the common electrode with the piezoelectric plates in between and measures capacitance with the common electrode, and the measurement electrode is disposed over the displacement portions and has substantially the same configuration and area as the common electrode.

In this piezoelectric actuator, by disposing the measurement electrode for capacitance measurement over the displacement portions, the capacitance of the piezoelectric plate between the common electrode and the measurement electrode can be measured with a large area, and by increasing the measured capacitance, the influence of the measurement error can be reduced.

The above and further objects and features of the invention will more fully be apparent from the following detailed description with accompanying drawings.

BRIEF DESCRIPTION OF THE SEVERAL VIEWS OF THE DRAWINGS

FIG. 8 shows an example of an applied voltage determination table in the ink-jet printer head;

DETAILED DESCRIPTION OF THE EXEMPLARY EMBODIMENTS

First Embodiment

Figure 1:
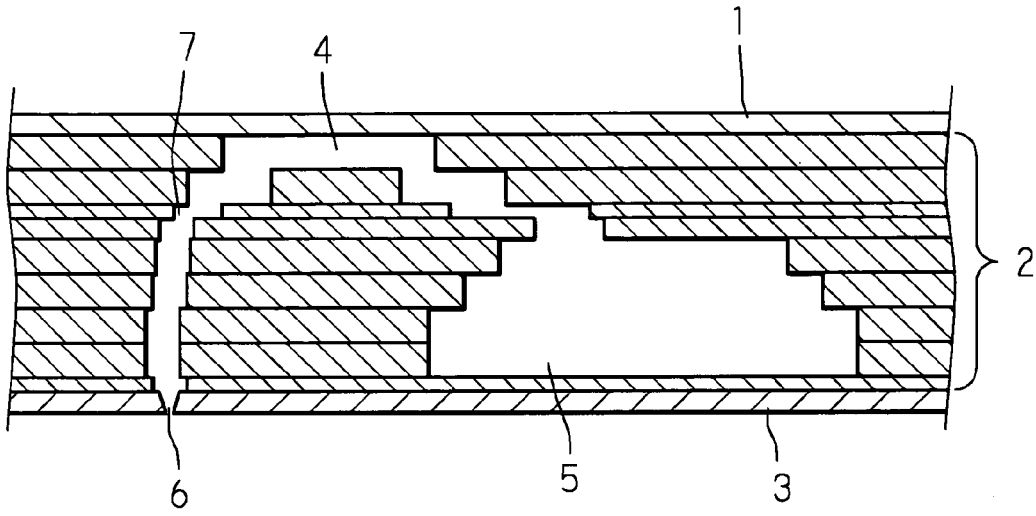
FIG. 1 is a cross-sectional view showing the structure of an ink-jet printer head.

FIG. 1 which is a cross-sectional view showing the structure of an ink-jet printer head is an enlarged view of one of a plurality of nozzles from which ink is jetted.

In the ink-jet printer head of the present embodiment, a piezoelectric plate portion 1 comprising a lamination of a plurality of piezoelectric plates is attached to a board portion 2. As shown in FIG. 1, the board portion 2 comprises a lamination of a plurality of metal boards, and these boards each have a plurality of through holes so as to correspond to each other. By laminating a plurality of boards, the through holes connect with each other in the lamination direction to form the following: a plurality of ink pressurizing chambers 4 for applying the pressure caused by the piezoelectric plate portion 1 to ink; an ink flow path 5 that distributes the ink from the ink cartridge (not shown) to the ink pressurizing chambers 4; and an ink jetting path 7 which is a flow path for jetting the pressurized ink to the outside. According to the present embodiment, the ink pressurizing chambers 4 are arranged in a direction vertical to the plane of FIG. 1 to form an ink pressurizing chamber row, and the ink flow path 5 extends along this row.

A nozzle plate 3 having a plurality of nozzles 6 for jetting ink onto the printing paper is attached to the surface of the board portion 2 opposite to the surface to which the piezoelectric plate portion 1 is attached. The nozzle plate 3 comprises a resin film, for example, a polyimide film where the nozzles 6 are formed by laser machining, and several hundred or several thousand nozzles 6 are arranged in parallel.

The nozzles 6 of the nozzle plate 3 are provided so as to correspond to the ink pressurizing chambers 4 and the ink jetting paths 7 formed in the board portion 2. The ink flow path 5 is common to the nozzles 6, and supplies ink from a non-illustrated ink cartridge to the nozzles 6 through their respective ink pressurizing chambers 4 and ink jetting paths 7. The ink in the ink flow path 5, the ink pressurizing chambers 4, the ink jetting paths 7 and the nozzles 6 is supplied from the ink cartridge without interruption, and in the nozzles 6, concave surfaces called menisci are formed on the ink surface.

To jet ink from the nozzles 6, the piezoelectric plate portion 1 constituting one walls of the ink pressurizing chambers 4 is selectively vibrated to thereby pressurize the ink in the ink pressurizing chambers 4. By displacing the piezoelectric plate portion 1 in a direction that narrows the ink pressurizing chambers 4, ink is jetted from the nozzles 6. After ink is jetted from the nozzles 6, the piezoelectric plate portion 1 is displaced in a direction that widens the ink pressurizing chambers 4 and the menisci formed in the nozzles 6 are temporarily retracted so that the printer head dries well. From the ink flow path 5, ink is newly supplied to the side of the ink pressurizing chambers 4 so as to make up for the jetted ink. By repeating the increase and decrease of the capacity of the ink pressurizing chambers 4 by the piezoelectric plate portion 1 and the ink supply from the ink flow path 5 in accordance therewith as described above, the time to the next ink jetting is reduced to thereby increase the printing speed.

Figure 2:
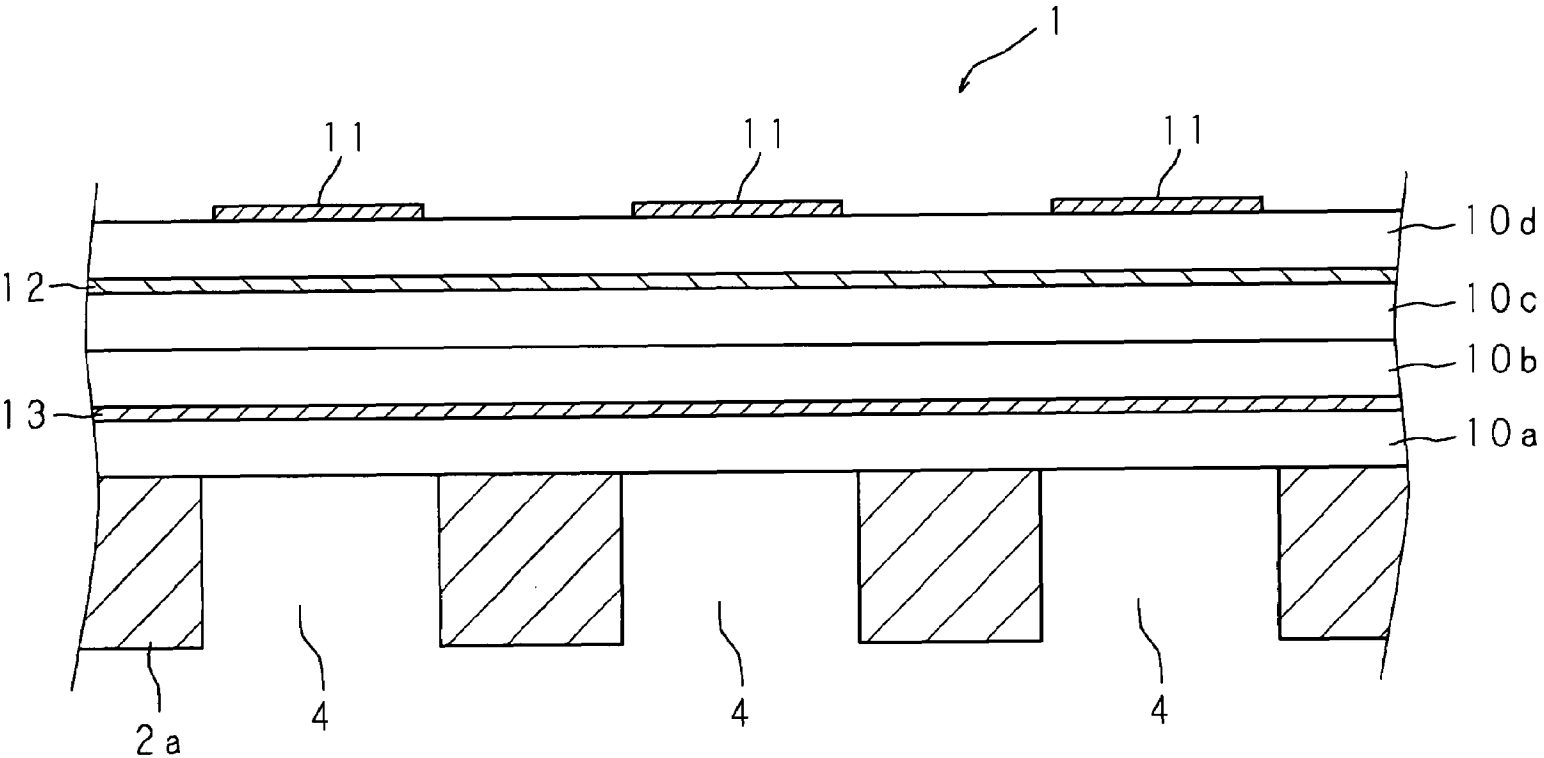
FIG. 2 is an enlarged cross-sectional view of a piezoelectric plate portion of the ink-jet printer head according to a first embodiment.

FIG. 2 which is an enlarged cross-sectional view of the piezoelectric plate portion 1 of the ink-jet printer head according to the first embodiment is an enlarged view of the cross section of the piezoelectric plate portion 1 corresponding to three ink pressurizing chambers 4. The piezoelectric plate portion 1 comprises a lamination of a first to a fourth piezoelectric plates. On a board 2*a* disposed on the outermost side among a plurality of boards constituting the board portion 2 and where the ink pressurizing chambers 4 are formed, the first piezoelectric plate 10*a*, the second piezoelectric plate 10*b* the third piezoelectric plate 10*c* and the fourth piezoelectric plate 10*d* are laminated in this order. These four piezoelectric plates have substantially the same thickness and area. This facilitates the control of the thickness (stiffness), the material or the like of each piezoelectric plate or the piezoelectric plate portion 1 as a lamination of the piezoelectric plates, which contributes to the setting of the ink jetting characteristic and its uniformalization. As the piezoelectric plates, for example, ceramic plates of $PbTiO_3$—$PbZrO_3$ are used.

On the board 2*a*, a plurality of ink pressurizing chambers 4 are formed in a row. On the outer surface of the fourth piezoelectric plate 10*d* constituting the outermost layer of the piezoelectric plate portion 1, a plurality of individual electrodes 11 are arranged so as to be opposed to the ink pressurizing chambers 4 with the piezoelectric plate portion 1 in between and to correspond to the ink pressurizing chambers 4 respectively.

A common electrode 12 serving as an electrode common to the corresponding individual electrodes 11 is disposed between the third piezoelectric plate 10*c* and the fourth piezoelectric plate 10*d*. The common electrode 12 has substantially the same configuration and area as the fourth piezoelectric plate 10*d*, and is opposed to all the individual electrodes 11 with the fourth piezoelectric plate 10*d* in between. A measurement electrode 13 for capacitance measurement is disposed between the first piezoelectric plate 10*a* and the second piezoelectric plate 10*b*. The measurement electrode 13 has substantially the same configuration and area as the common electrode 12, and is opposed to the common electrode 12 with the second piezoelectric plate 10*b* and the third piezoelectric plate 10*c* in between and opposed to all the ink pressurizing chambers 4 with the first piezoelectric plate 10*a* in between. The individual electrodes 11, the common electrode 12 and the measurement electrode 13 are made of silver or an alloy containing silver. As described above, the common electrode 12 and the measurement electrode 13 both have substantially the same configuration and area as the piezoelectric plates, and do not restrict the arrangement of the individual electrodes 11. That is, the individual electrodes 11 formed on the outermost surface of the piezoelectric plate portion 1 have a high degree of freedom in arrangement, and can easily adjust to high-density arrangement.

The common electrode 12 is held at the ground potential. To each of the individual electrodes 11, a non-illustrated driving circuit is connected so that a voltage can be selectively applied to the individual electrodes 11. When a voltage is applied between the individual electrodes 11 and the common electrode 12, a part of the fourth piezoelectric plate 10*d* sandwiched between the individual electrodes 11 and the common electrode 12 becomes displaced by itself. With the displacement of the fourth piezoelectric plate 10*d*, the third piezoelectric plate 10*c*, the second piezoelectric plate 10*b* and the first piezoelectric plate 10*a* become displaced, so that the ink in the ink pressurizing chambers 4 is pressurized. At this time, when a negative voltage is applied to the individual electrodes 11, the piezoelectric plates are displaced in a direction that widens the ink pressurizing chambers 4, and when a positive voltage is applied thereto, the piezoelectric plates are displaced in a direction that narrows the ink pressurizing chambers 4.

The measurement electrode 13 is provided for measuring the capacitance of the second piezoelectric plate 10*b* and the third piezoelectric plate 10*c* sandwiched between the measurement electrode 13 and the common electrode 12. By comparing the previously obtained capacitance-temperature characteristics of the piezoelectric plates with the capacitance measured by the measurement electrode 13, the temperature of the second piezoelectric plate 10*b* and the third piezoelectric plate 10*c* is calculated. The temperature of the second piezoelectric plate 10*b* and the third piezoelectric plate 10*c* is substantially the same as the temperature of the ink in the ink pressurizing chambers 4. For this reason, by changing the voltage applied to the individual electrodes 11 according to the calculated temperature, a pressure suitable for the ink viscosity can be applied to the ink in the ink pressurizing chambers 4.

Figure 3:
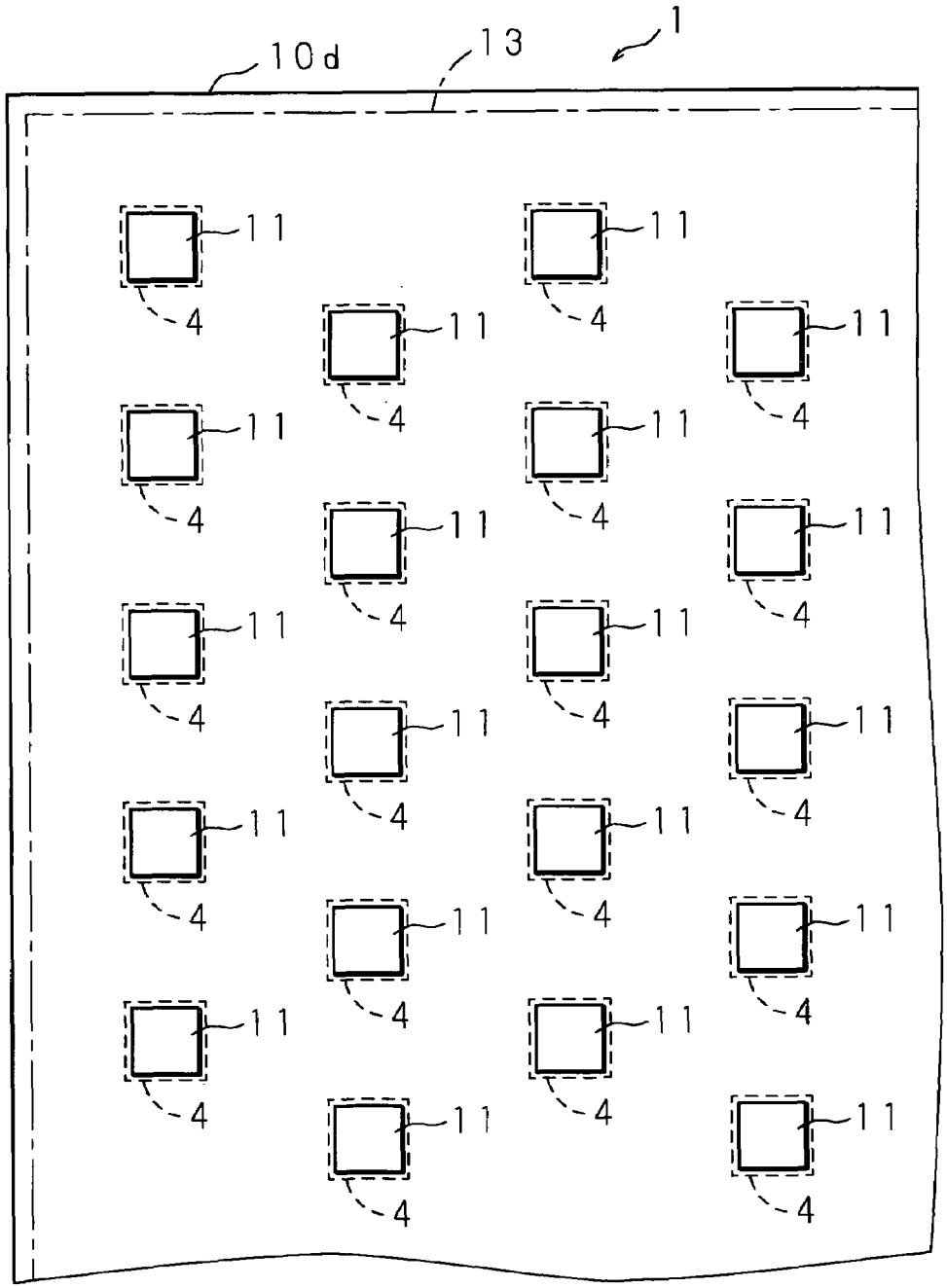
FIG. 3 is a schematic view showing the two-dimensional arrangement of individual electrodes of the ink-jet printer head.

FIG. 3 is a schematic view showing the two-dimensional arrangement of the individual electrodes 11 of the ink-jet printer head. The wiring from the printer main body to the individual electrodes 11 is not shown. On the surface of the fourth piezoelectric plate 10*d*, a plurality of individual electrodes 11 are arranged at predetermined intervals substantially in a staggered configuration. The ink pressurizing chambers 4 (shown by the broken lines in FIG. 3) are arranged substantially in a staggered configuration so as to correspond to the individual electrodes 11 respectively with the piezoelectric plate portion 1 in between. The measurement electrode 13 (shown by the chain line in FIG. 3) has substantially the same size as the fourth piezoelectric plate 10*d*, and is arranged so as to be opposed to all the individual electrodes 11. The nozzles 6 are provided so as to correspond to the individual electrodes 11 and the ink pressurizing chambers 4 respectively, and by applying a predetermined voltage to the individual electrodes 11 corresponding to the nozzles 6 from which ink is to be jetted, ink is selectively jetted from a plurality of nozzles 6 to thereby form characters or images on the printing paper.

Figure 4:
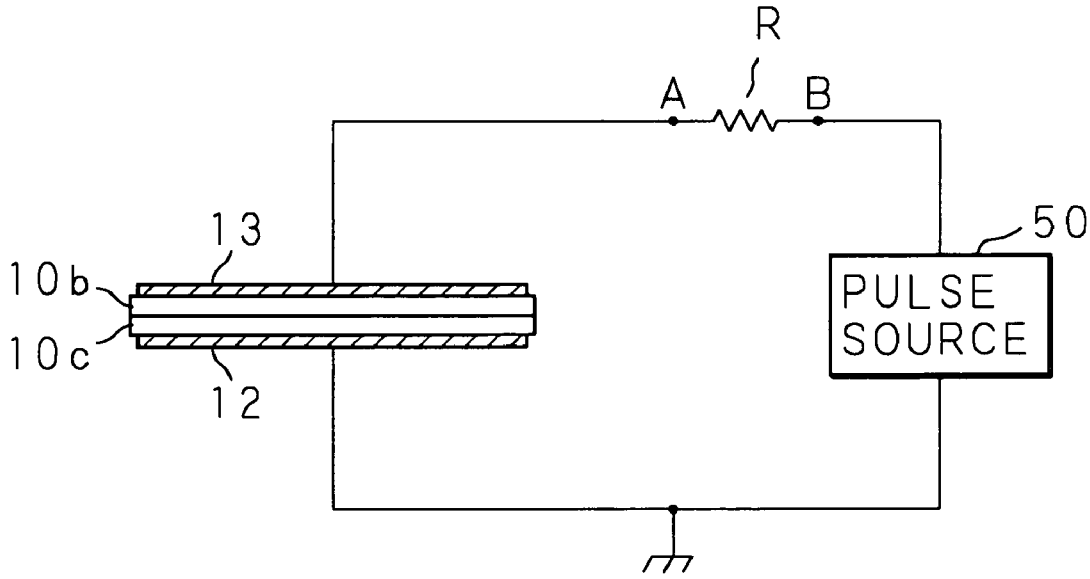
FIG. 4 is a schematic view showing a capacitance measuring circuit of piezoelectric plates of the ink-jet printer head.

FIG. 4 is a schematic view showing a capacitance measuring circuit of the piezoelectric plates of the ink-jet printer head. FIGS. 5A to 5D are explanatory views for explaining the capacitance measurement method of the piezoelectric plates of the ink-jet printer head. According to the present embodiment, the capacitance of the second piezoelectric plate 10*b* and the third piezoelectric plate 10*c* is measured to thereby calculate the temperature. The common electrode 12 and the measurement electrode 13 opposed to each other with the second piezoelectric plate 10*b* and the third piezoelectric plate 10*c* in between are connected to a pulse source 50 so that a pulse voltage can be applied to the electrodes 12 and 13. However, the measurement electrode 13 is connected to the pulse source through a resistor R. Moreover, the common electrode 12 is set at the ground potential.

Figure 5A:
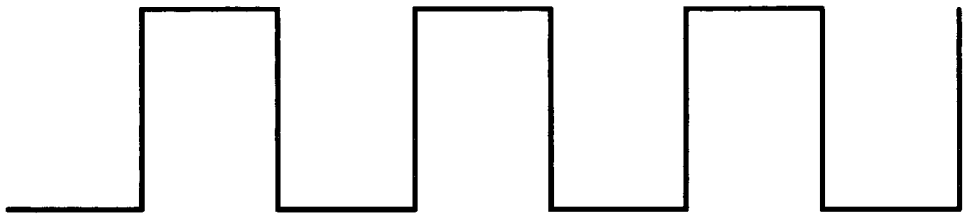
FIGS. 5A to 5D are explanatory views for explaining the capacitance measurement method of the piezoelectric plates of the ink-jet printer head.
Figure 5B:
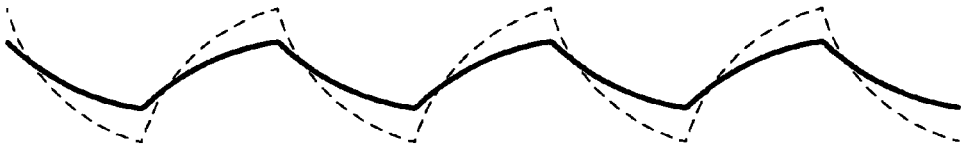
Figure 5C:
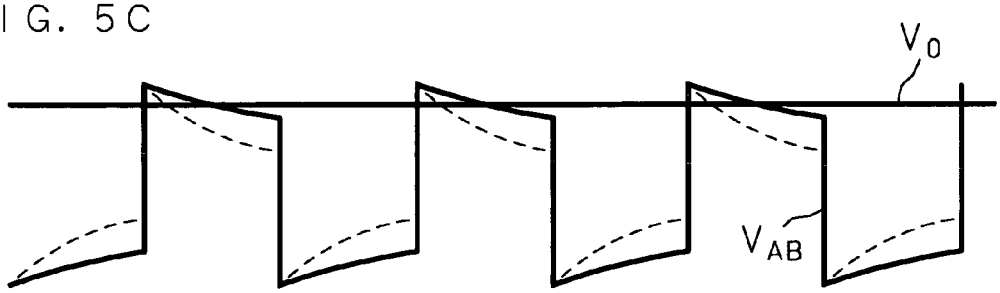

The pulse source 50 generates a substantially rectangular pulse voltage. The waveform of the pulse voltage generated by the pulse source 50 is shown in FIG. 5A. This pulse voltage is applied between the electrodes through the resistor R. For this reason, in accordance with the time constant determined by the resistance of the resistor R and the capacitance of the second piezoelectric plate 10*b* and the third piezoelectric plate 10*c*, the change of the pulse voltage is delayed, so that at the measurement electrode 13, the waveform is such that the rising and the falling are delayed as shown in FIG. 5B. The waveform of a voltage $V_{AB}$ between both ends (indicated by the points A and B in FIG. 4) of the resistor R at this time is as shown in FIG. 5C. Of the waveforms shown in FIGS. 5B to 5D, the ones shown by the solid lines are the waveforms when the 15 capacitance of the second piezoelectric plate 10*b* and the third piezoelectric plate 10*c* is large, and the ones shown by the broken lines are the waveforms when the capacitance is small.

Figure 5D:
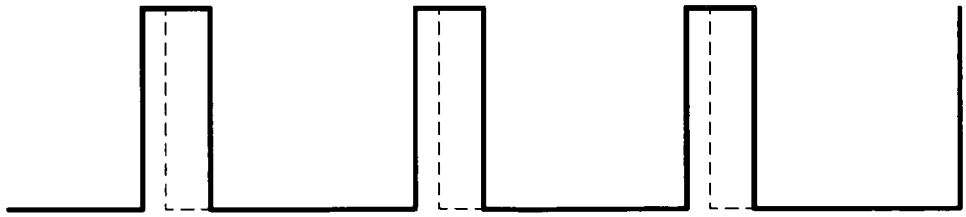

The change of the voltage $V_{AB}$ is determined by a comparator (not shown) that compares the voltage $V_{AB}$ between both ends of the resistor R with a constant voltage $V_0$ supplied from a constant voltage source (not shown), outputs HIGH when $V_{AB}$ is higher than $V_0$, and outputs Low when $V_{AB}$ is lower than $V_0$. FIG. 5D shows the output result of the comparator. The output result of the comparator is a rectangular wave, and the larger the capacitance of the second piezoelectric plate 10*b* and the third piezoelectric plate 10*c* is, the longer the output time of HIGH is. For this reason, the capacitance of the second piezoelectric plate 10*b* and the third piezoelectric plate 10*c* can be obtained from the HIGH output time of the output waveform of the comparator.

Figure 6:
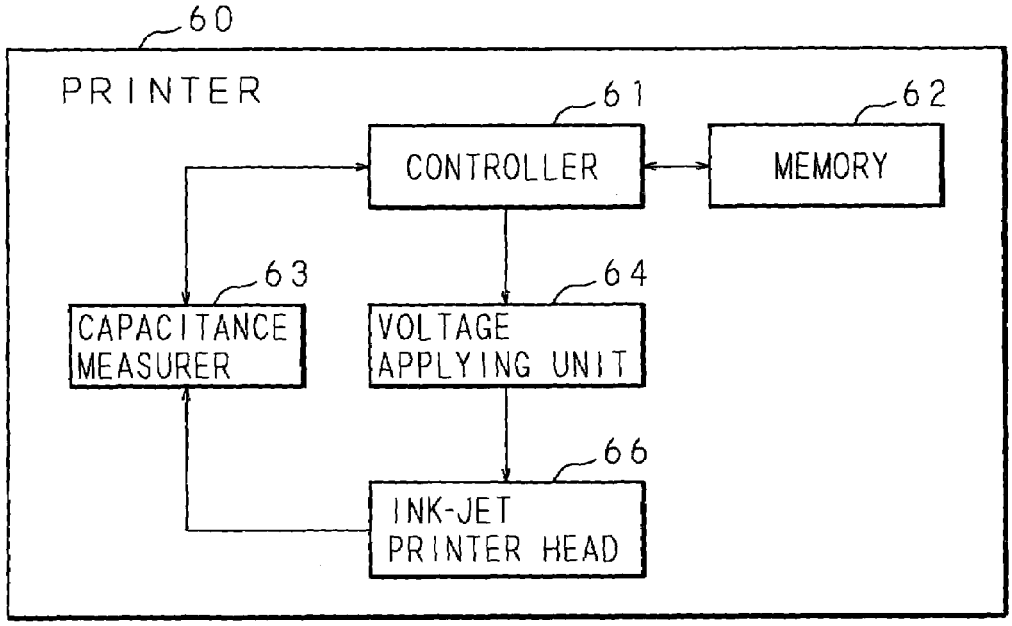
FIG. 6 is a block diagram showing the structure of a printer provided with the ink-jet printer head.

FIG. 6 is a block diagram showing the structure of a printer provided with the ink-jet printer head. In FIG. 6, the printer 60 has an ink-jet printer head 66, a voltage applying unit 64 that applies a voltage to the individual electrodes 11 of the ink-jet printer head 66, a capacitance measurer 63 that measures the capacitance of the piezoelectric plates of the ink-jet printer head 66, a controller 61 that controls these components, and a memory 62 storing information necessary for the controller 61 to perform the control processing.

The voltage applying unit 64 is supplied with information such as the positions of the individual electrodes 11 to which a voltage is to be applied, the applied voltage and the application time from the controller 61, and applies the voltage to the individual electrodes 11 based on the information. The capacitance measurer 63 measures the capacitance of the piezoelectric plates by the above-described method, and supplies the measurement result to the controller 61. In the memory 62, an applied voltage determination table for determining the applied voltage from the capacitance-temperature characteristic and the temperature of the piezoelectric plates is stored. With reference to the measurement result of the capacitance measurer 63, and the capacitance-temperature characteristic and the applied voltage determination table stored in the memory 62, the controller 61 determines the applied voltage, and supplies it to the voltage applying unit 64.

Figure 7:
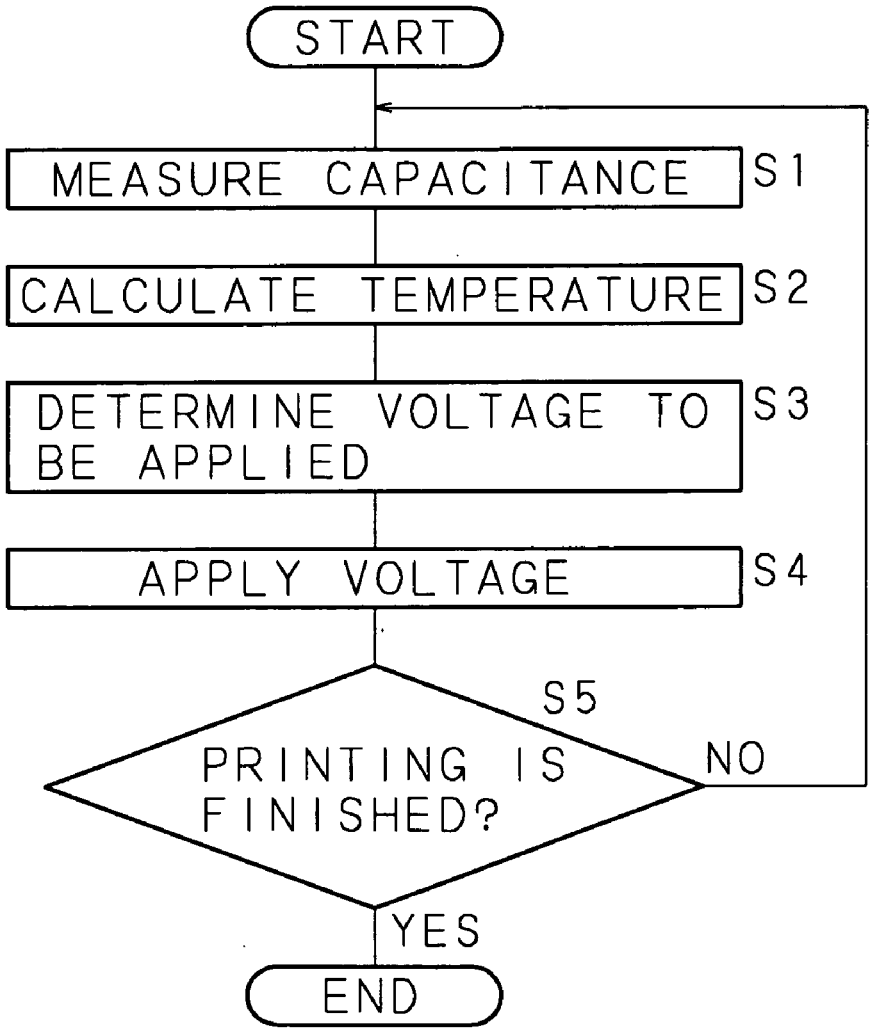
FIG. 7 is a flowchart showing the processing procedure performed by a controller of the printer provided with the ink-jet printer head.

FIG. 7 is a flowchart showing the processing procedure performed by the controller of the printer provided with the ink-jet printer head. When printing is started, the controller 61 measures the capacitance of the piezoelectric plates of the ink-jet printer head 66 by the capacitance measurer 63 (step S1). Then, the controller 61 calculates the temperature of the piezoelectric plates from the capacitance obtained with reference to the capacitance-temperature characteristic stored in the memory 62 (step S2), and determines the voltage to be applied to the individual electrodes 11 of the piezoelectric plates from the temperature calculated with reference to the applied voltage determination table stored in the memory 62 (step S3).

Then, the determined voltage is supplied to the voltage applying unit 64, and the voltage is applied to the individual electrodes 11 of the piezoelectric plates (step S4). Consequently, ink is jetted from the nozzles 6 of the ink-jet printer head 66. After the voltage application, whether printing is finished or not is determined (step S5). When printing is not finished (S5: NO), the process returns to step S1, and the capacitance measurement and the voltage application are repeated. When printing is finished (S5: YES), the processing is ended.

By the above-described processing, in the printer 60, a voltage suitable for the ink temperature can be applied to the individual electrodes 11 of the ink-jet printer head 66, so that printing suitable for the ink temperature that changes according to the status of use such as immediately after the printer 60 is turned on or after the printer 60 is continuously used can be performed. The controller 61 controls the voltage application time based on the applied voltage determination table as well as the applied voltage. An example of the applied voltage determination table is shown in FIG. 8.

In FIG. 8, temperature ranges are shown in steps of 2 degrees centigrade in the left column, the applied voltages for the temperatures are shown in the central column, and the kinds of waveforms when the voltage is applied are shown in the right column. The applied voltage is determined according to the measured temperature, one waveform is selected from among three kinds of waveforms for low temperatures (A), for room temperatures (B) and for high temperatures (C), and the voltage is applied to the individual electrodes 11.

Figure 9A:
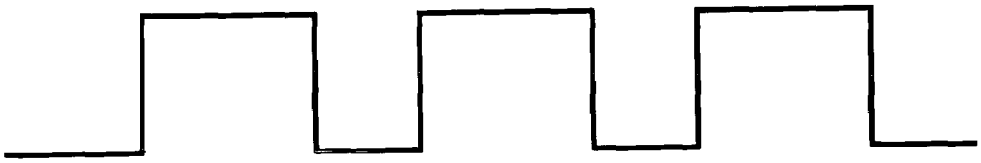
FIGS. 9A to 9C are schematic waveform charts of the voltage applied to the individual electrodes of the ink-jet printer head.
Figure 9B:
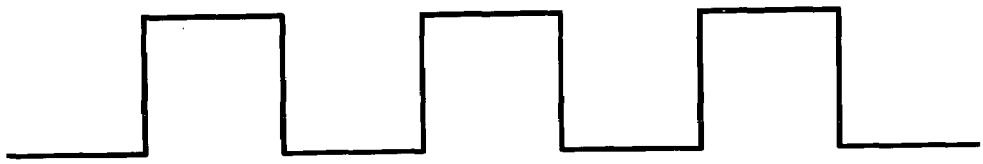
Figure 9C:
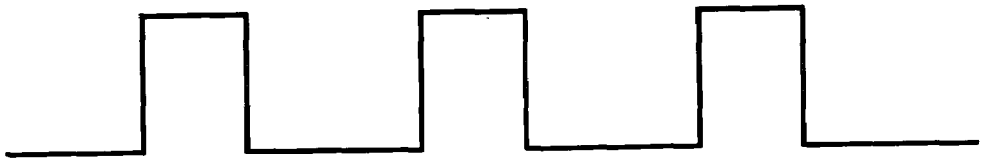

FIGS. 9A to 9C are schematic waveform charts of the voltage applied to the individual electrodes of the ink-jet printer head. The waveforms shown in FIGS. 9A to 9C are waveforms when one dot is formed of three drops of ink. FIG. 9A shows a waveform for low temperatures. FIG. 9B shows a waveform for room temperatures. FIG. 9C shows a waveform for high temperatures. As shown in the figures, at low temperatures, the pulse width is large so that the voltage application time is long, and at high temperatures, the pulse width is small so that the voltage application time is short. When the temperature of the ink-jet printer head is less than 18 degrees centigrade as a result of the temperature measurement, a voltage of the waveform for low temperatures is applied to the individual electrodes 11 so that the highest voltage is the voltage determined by FIG. 8. When the temperature of the ink-jet printer head is not less than 18 degrees centigrade and less than 34 degrees centigrade, a voltage of the waveform for room temperatures is applied, and when the temperature is not less than 34 degrees centigrade, a voltage of the waveform for high temperatures is applied.

By measuring the capacitance of the piezoelectric plates by use of the measurement electrode provided in the ink-jet printer head by the above-described structure, the temperature of the piezoelectric plate can be calculated, and by changing the voltage applied to the individual electrodes 11 according to the calculated temperature, a pressure suitable for the ink viscosity can be caused by the piezoelectric plate portion 1, so that printing quality can be maintained.

In the piezoelectric plate portion 1, the orders of lamination from the center in the lamination direction (the surface where the second piezoelectric plate 10*b* and the third piezoelectric plate 10*c* are in contact with each other) to both sides in the lamination direction are both a piezoelectric plate, an electrode and a piezoelectric plate so that the layers are arranged symmetrically with respect to the center. By this structure, the stress caused by the difference in expansion rate between the piezoelectric plate and the electrode can be made the same, so that the piezoelectric plate portion 1 never warps to one side. Consequently, the rate of occurrence of defects in the manufacturing process can be reduced.

While in the present embodiment, the individual electrodes 11 are arranged in a staggered configuration on the outer surface of the fourth piezoelectric plate 10*d* as shown in FIG. 3, the present invention is not limited thereto: the individual electrodes 11 may be arranged differently. The numerical values in the table for determining the applied voltage from the measured temperatures shown in FIG. 8 are merely an example, and the present invention is not limited thereto; as the temperature condition and the applied voltage, ones suitable for the ink-jet printer head are used. While the voltage application time is changed by changing the waveform of the applied voltage according to the temperature, the present invention is not limited thereto. For example, the number of times of voltage application may be changed, and further, these are not necessarily performed. Moreover, the method of measuring the capacitance of the piezoelectric plates between the common electrode 12 and the measurement electrode 13 is merely an example, and the following method may be used.

Figure 10:
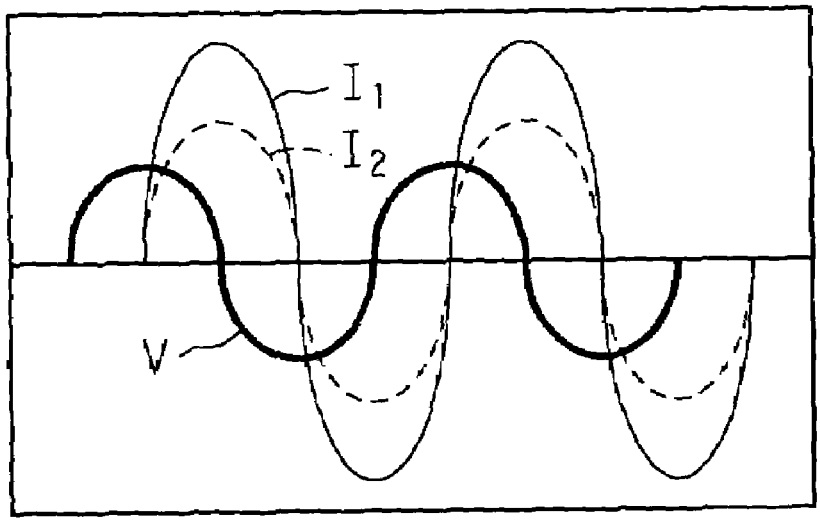
FIG. 10 is an explanatory view for explaining another capacitance measurement method for the ink-jet printer head.

FIG. 10 is an explanatory view for explaining another capacitance measurement method for the ink-jet printer head. The measuring circuit itself is the same as that shown in FIG. 4.

In FIG. 10, the horizontal axis is the time axis, V is the waveform of the voltage generated by the pulse source 50, and $I_1$ and $I_2$ are the waveforms of the current flowing through the resistor R. The voltage V has a sinusoidal waveform with a peak value of approximately 1 V, and is applied between the measurement electrode 13 and the common electrode 12. Since the amount of current flowing through the resistor R corresponds to the capacitance of the second piezoelectric plate 10*b* and the third piezoelectric plate 10*c* between the measurement electrode 13 and the common electrode 12, when the capacitance of the second piezoelectric plate 10*b* and the third piezoelectric plate 10*c* is increased or decreased by a temperature change, the amount of current is increased or decreased accordingly. $I_1$ is the waveform of the current flowing through the resistor R when the temperature is high, and $I_2$ is the waveform when the temperature is low. Consequently, by measuring the rms value or the peak value of the current flowing through the resistor R, the capacitance of the second piezoelectric plate 10*b* and the third piezoelectric plate 10*c* can be calculated.

While in the measurement method shown in FIG. 10, the waveform of the voltage applied by the pulse source 50 is a sinusoidal wave, the present invention is not limited thereto; it may be a different kind of wave such as a rectangular wave or a triangular wave. While the applied voltage is approximately 1 V, the present invention is not limited thereto.

Second Embodiment

Figure 11:
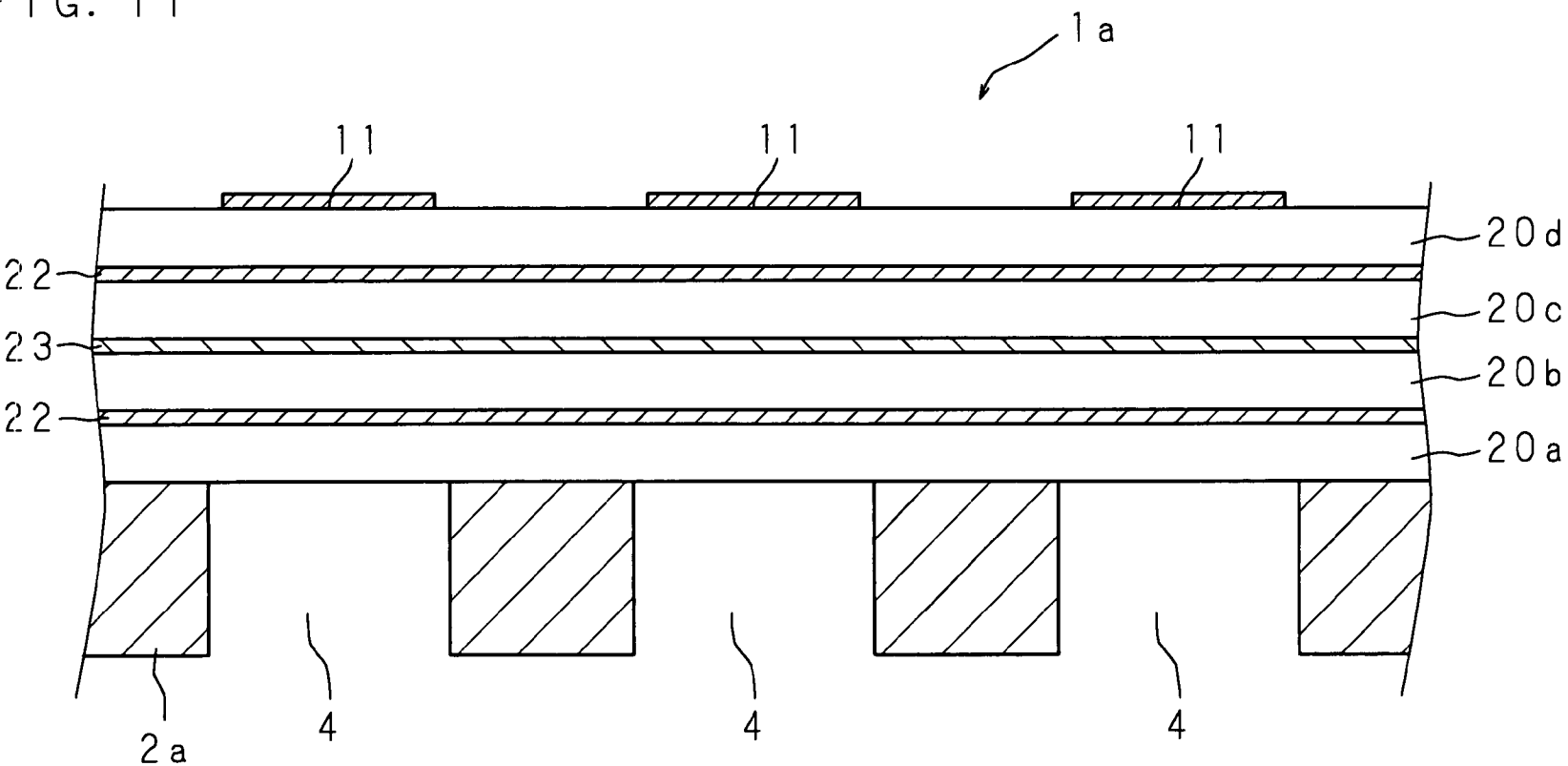
FIG. 11 is an enlarged cross-sectional view of a piezoelectric plate portion of an ink-jet printer head according to a second embodiment.

FIG. 11 is an enlarged cross-sectional view of a piezoelectric plate portion 1*a* of an ink-jet printer head according to a second embodiment. The piezoelectric plate portion 1*a* comprises a lamination of a first to a fourth piezoelectric plates which are laminated in the order of the first piezoelectric plate 20*a*, the second piezoelectric plate 20*b*, the third piezoelectric plate 20*c* and the fourth piezoelectric plate 20*d* on the board 2*a* where the ink pressurizing chambers 4 are formed. These four piezoelectric plates have substantially the same thickness, configuration and area.

On the board 2*a*, a plurality of ink pressurizing chambers 4 are formed. On the outer surface of the fourth piezoelectric plate 20*d* constituting the outermost layer of the piezoelectric plate portion 1*a*, a plurality of individual electrodes 11 are arranged so as to be opposed to the ink pressurizing chambers 4 with the piezoelectric plate portion 1*a* in between and to correspond to the ink pressurizing chambers 4 respectively.

Common electrodes 22 are disposed between the first piezoelectric plate 20*a* and the second piezoelectric plate 20*b* and between the third piezoelectric plate 20*c* and the fourth piezoelectric plate 20*d*. The common electrodes 22 have substantially the same configuration and area as the piezoelectric plates, and are opposed to all the individual electrodes 11. A measurement electrode 23 for capacitance measurement is disposed between the second piezoelectric plate 20*b* and the third piezoelectric plate 20*c*. The measurement electrode 23 has substantially the same configuration and area as the common electrodes 22, and is opposed to the two common electrodes 22 with the second piezoelectric plate 20*b* and the third piezoelectric plate 20*c* in between. Moreover, the measurement electrode 23 is opposed to all the individual electrodes 4 with the common electrode 22 and the second piezoelectric plate 20*b* in between.

In the ink-jet printer head according to the second embodiment having the above-described structure, the area of the common electrode opposed to the measurement electrode is twice that in the ink-jet printer head according to the first embodiment, and since the number of piezoelectric plates between the measurement electrode and the common electrode is one, the distance between these electrodes is half. Consequently, the capacitance measured by the measurement electrode 23 can be increased, so that the measurement accuracy can be increased.

In the piezoelectric plate portion 1*a*, the orders of lamination from the center in the lamination direction (the measurement electrode 23) to both sides in the lamination direction are both a piezoelectric plate, an electrode and a piezoelectric plate and are the same. By this structure, the stress caused by the difference in expansion rate between the piezoelectric plate and the electrode can be made the same, so that the piezoelectric plate portion 1*a* never warps to one side. Consequently, the rate of occurrence of defects in the manufacturing process can be reduced. Further, the common electrode 22 set at the ground potential during operation is disposed closest to the ink pressurizing chamber 4 filled with ink. In some ink-jet printer heads, a board 2*a* of metal is disposed in order to avoid a potential change due to charging during operation. In printer heads having such a structure, since an electrode set at a potential different from the ground potential is adjacent, a potential difference occurs with the board 2*a* or the ink, and there is a possibility that the potential difference triggers corrosion or damage of the electrode by the ink. However, such a potential difference does not occur between the board 2*a* and the ink, which contributes to a prolonged life of the ink-jet printer head.

The remaining structures of the ink-jet printer head according to the second embodiment are similar to those of the ink-jet printer head according to the first embodiment. Therefore, the corresponding parts are denoted by the same reference numerals, and detailed descriptions thereof are omitted.

Third Embodiment

Figure 12:
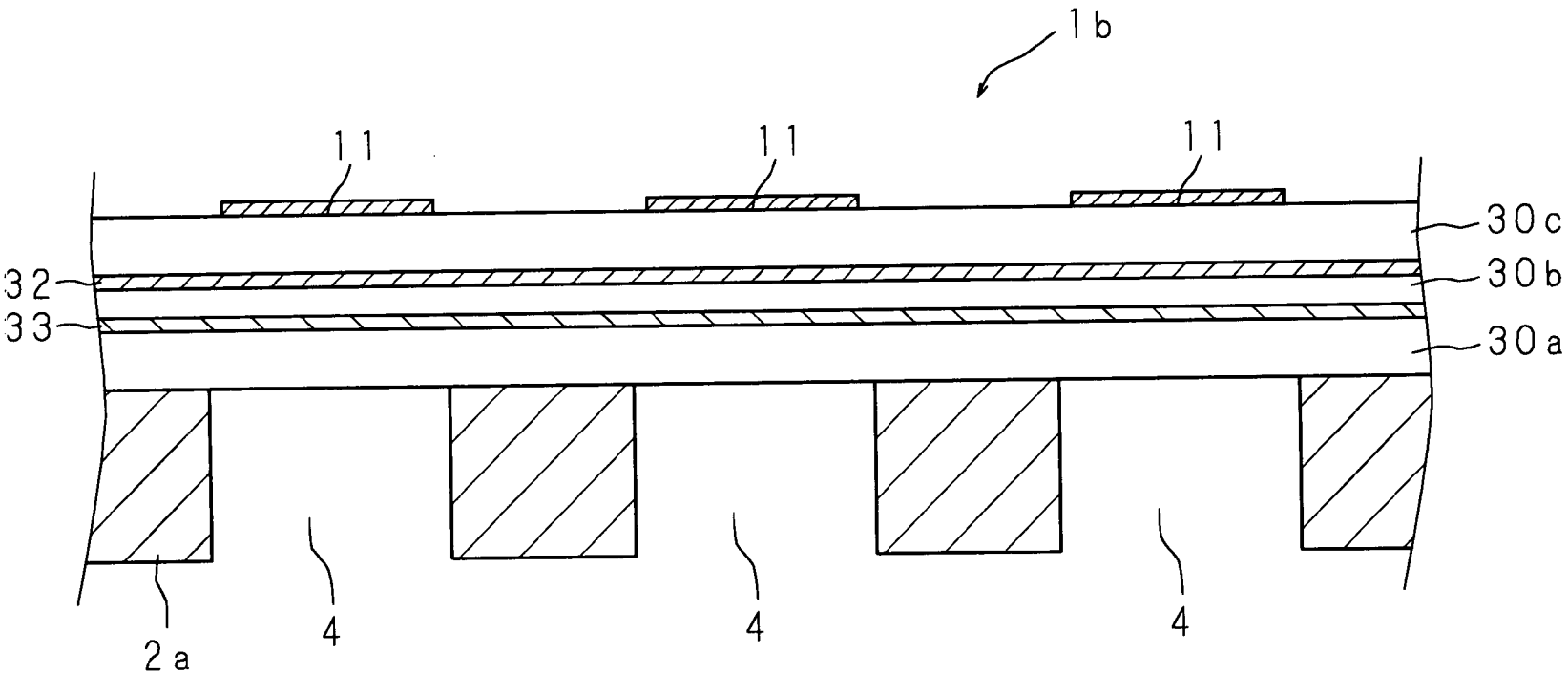
FIG. 12 is an enlarged cross-sectional view of a piezoelectric plate portion of an ink-jet printer head according to a third embodiment.

FIG. 12 is an enlarged cross-sectional view of a piezoelectric plate portion 1*b* of an ink-jet printer head according to a third embodiment. The piezoelectric plate portion 1*b* comprises a lamination of a first to a third piezoelectric plates which are laminated in the order of the first piezoelectric plate 30*a*, the second piezoelectric plate 30*b* and the third piezoelectric plate 30*c* on the board 2*a* where the ink pressurizing chambers 4 are formed. The thickness of the second piezoelectric plate 30*b* is substantially half the thickness of the first piezoelectric plate 30*a* and the third piezoelectric plate 30*c*. The first piezoelectric plate 30*a*, the second piezoelectric plate 30*b* and the third piezoelectric plate 30*c* have substantially the same configuration and area.

On the board 2*a*, a plurality of ink pressurizing chambers 4 are formed. On the outer surface of the third piezoelectric plate 30*c* constituting the outermost layer of the piezoelectric plate portion 1*b*, a plurality of individual electrodes 11 are arranged so as to be opposed to the ink pressurizing chambers 4 with the piezoelectric plate portion 1*b* in between and to correspond to the ink pressurizing chambers 4 respectively.

A common electrode 32 is disposed between the second piezoelectric plate 30*b* and the third piezoelectric plate 30*c*. The common electrode 32 has substantially the same configuration and area as the third piezoelectric plate 30*c*, and is opposed to all the individual electrodes 11. A measurement electrode 33 for capacitance measurement is disposed between the first piezoelectric plate 30*a* and the second piezoelectric plate 30*b*. The measurement electrode 33 has substantially the same configuration and area as the common electrode 32, and is opposed to the common electrode 32 with the second piezoelectric plate 30*b* in between. The measurement electrode 33 is also opposed to all the ink pressurizing chambers 4 with the first piezoelectric plate 30*a* in between.

In the ink-jet printer head according to the third embodiment having the above-described structure, since the number of piezoelectric plates between the measurement electrode and the common electrode is one and the thickness is half, the distance between these electrodes is approximately one quarter, compared to the ink-jet printer head according to the first embodiment. Consequently, the capacitance measured by the measurement electrode 33 can be increased, so that the measurement accuracy can be increased.

In the piezoelectric plate portion 1*b*, the orders of lamination from the center in the lamination direction (the center of the second piezoelectric plate 30*b*) to both sides in the lamination direction are both a piezoelectric plate, an electrode and a piezoelectric plate so that the layers are arranged symmetrically with respect to the center. By this structure, the stress caused by the difference in expansion rate between the piezoelectric plate and the electrode can be made the same, so that the piezoelectric plate portion 1*b* never warps to one side. Consequently, the rate of occurrence of defects in the manufacturing process can be reduced.

The remaining structures of the ink-jet printer head according to the third embodiment are similar to those of the ink-jet printer head according to the first embodiment. Therefore, the corresponding parts are denoted by the same reference numerals, and detailed descriptions thereof are omitted.

Fourth Embodiment

Figure 13:
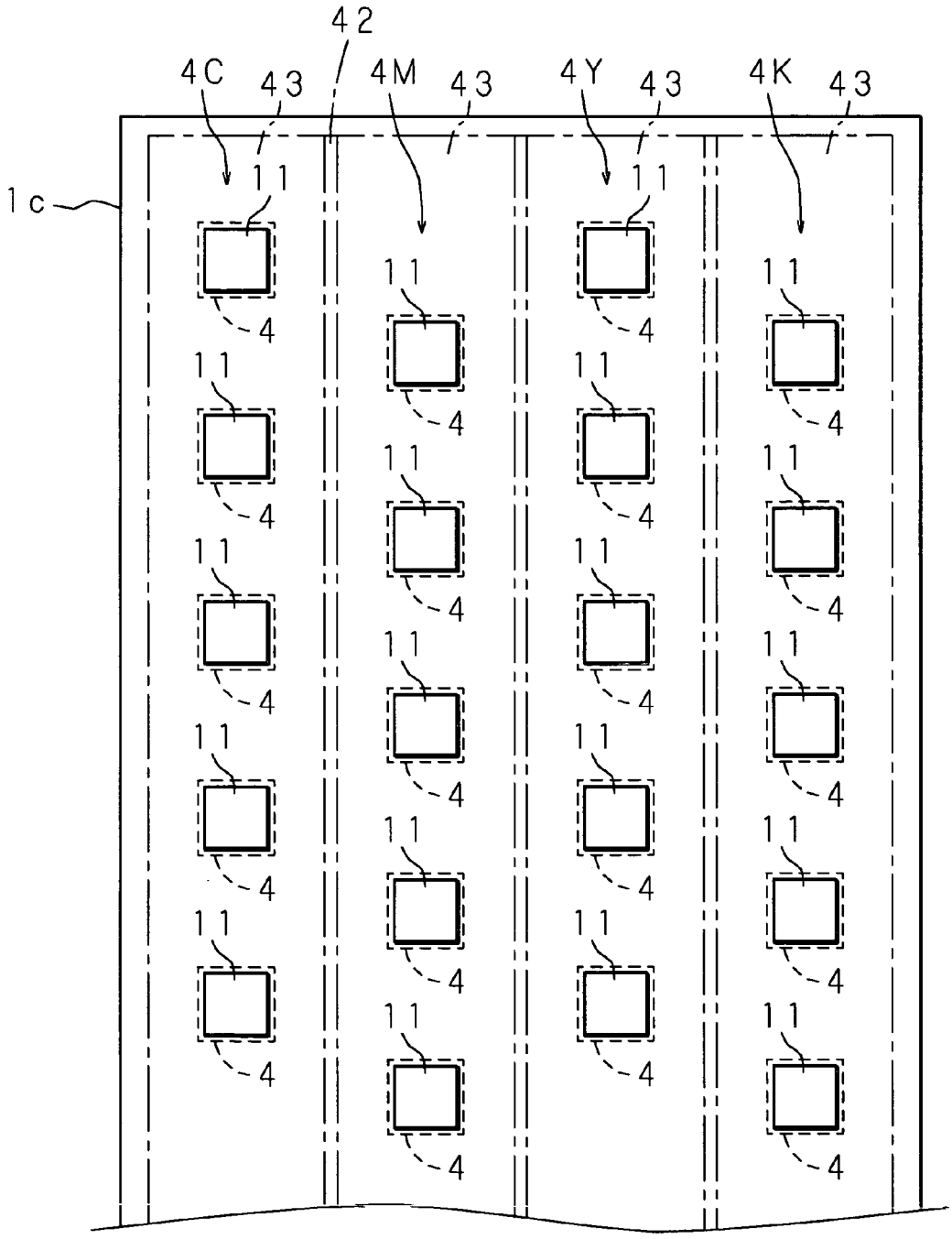
FIG. 13 is a schematic view showing the two-dimensional arrangement of a measurement electrode of an ink-jet printer head according to a fourth embodiment.

FIG. 13 is a schematic view showing the two-dimensional arrangement of the measurement electrode of an ink-jet printer head according to a fourth embodiment. In FIG. 13, a piezoelectric plate portion 1*c* comprising a lamination of a plurality of piezoelectric plates is attached to the board portion. On the board portion, a plurality of ink pressurizing chambers (shown by the broken lines in FIG. 13) are arranged in four rows substantially in a staggered configuration. The groups of ink pressurizing chambers 4 arranged in the same rows correspond to inks of cyan, magenta, yellow and black, respectively. The four ink pressurizing chamber groups are arranged in the order of a cyan ink pressurizing chamber group 4C, a magenta ink pressurizing chamber group 4M, a yellow ink pressurizing chamber group 4Y, and a black ink pressurizing chamber group 4K from one side.

On the upper surface of the piezoelectric plate portion 1*c*, a plurality of individual electrodes 11 are disposed in positions opposed to the ink pressurizing chambers 4 with the piezoelectric plate portion 1*c* in between. Between the piezoelectric plates of the piezoelectric plate portion 1*c*, four measurement electrodes 43 (shown by the chain lines in FIG. 13) are juxtaposed so as to correspond to the four ink pressurizing chamber groups 4C, 4M, 4Y and 4K. The measurement electrodes 43 measure the capacitance of the piezoelectric plates for each ink pressurizing chamber group. The individual electrodes 11 apply different voltages to their corresponding ink pressurizing chamber groups. The measurement electrodes 43 are disposed on the same piezoelectric plate of the piezoelectric plate portion 1*c*. A common electrode 42 opposed to the individual electrodes 11 and set at the ground potential has substantially the same configuration and area as the piezoelectric plates, and when viewed two-dimensionally, the perimeter thereof substantially coincides with the perimeter of the area where the four measurement electrodes 43 are arranged.

In the ink-jet printer having the above-described structure, by providing the measurement electrode 43 for each color of ink, the temperature can be measured individually for each color of ink. Although inks of the same color highly likely have the same temperature since they connect with each other in the ink flow path, inks of different colors possibly have different temperatures since they flow through different ink flow paths and contain different components. For this reason, by measuring the temperature for each color of ink and changing the voltage applied to the individual electrodes 11, a more suitable pressure can be applied to the ink. As described above, since not only the capacitance suitable for the status of use of the ink-jet printer head can be measured but also it is unnecessary to perform the measurement on the entire surface at a time, the load of the power source associated with the measurement is reduced. While in the present embodiment, the common electrode 42 and the piezoelectric plates have substantially the same configuration and area and the measurement electrode 43 is provided for each color of ink, their two-dimensional configurations may be formed so as to be in an opposite relationship.

Namely, the measurement electrode 43 may have substantially the same configuration and area as the piezoelectric plates and the common electrode 42 may be divided for respective colors of ink. Further, both of the common electrode 42 and the measurement electrode 43 may be divided for respective colors of ink.

The remaining structures of the ink-jet printer head according to the fourth embodiment are similar to those of the ink-jet printer head according to the first embodiment. Therefore, the corresponding parts are denoted by the same reference numerals, and detailed descriptions thereof are omitted.

In any of the embodiments, the ink flow path 5 extends along a plurality of ink pressurizing chambers 4 arranged in a row. The ink flow path 5 is supplied with ink from the outside (ink cartridge), and there are cases where by fresh ink flowing in, a temperature distribution corresponding to the distance from the ink supplier from which ink is supplied occurs depending on the length of the ink flow path 5. Therefore, the capacitance measurement area may be divided into a plurality of parts (in other words, ink pressurizing chamber groups may be formed) in accordance with the distance from the ink supplier of the ink flow path 5. Thereby, the voltage applied to the individual electrodes 11 can be changed also in accordance with the temperature distribution due to the ink supply.

With respect to the common electrode 12 (22, 32, 42) opposed to the individual electrodes 11, the measurement electrode 13 (23, 33, 43) is disposed on the opposite side of the individual electrodes 11. At this time, the piezoelectric plates the capacitance of which is measured are disposed substantially in the center in the lamination direction of the piezoelectric plate portion 1 (1*a*, 1*b*, 1*c*). That is, the voluntary displacement portion that changes the capacity of the ink pressurizing chambers 4 and serves as a heat source and the ink which is the object of the temperature measurement are disposed with the piezoelectric plates the capacitance of which is measured in between. Consequently, the temperature of the ink together with the piezoelectric plate portion 1 (1*a*, 1*b*, 1*c*) can be measured quickly and accurately.

It is to be noted that the above-described structures are applicable not only to ink-jet printer heads but also to piezoelectric actuators and displacers that measure the temperature from the capacitance of the piezoelectric material and control the displacement amount of the displacement portion of the piezoelectric material according to the temperature. For example, similar structures are applicable to piezoelectric displacers in which a common electrode opposed to a plurality of individual electrodes with a piezoelectric material in between is provided and a measurement electrode that is opposed to the common electrode with another piezoelectric material in between and measures the capacitance with the common electrode is disposed. In this case, like the above-described embodiments, the following structure may be adopted: a plurality of individual electrode groups are formed of a plurality of individual electrodes, a plurality of individual electrode groups are provided, and one or both of the measurement electrode and the common electrode are divided and disposed so as to be opposed to the individual electrode groups. The thicknesses of all the piezoelectric material may be the same, and the piezoelectric material sandwiched between the common electrode and the measurement electrode may be thinner than the other piezoelectric materials.

As described above in detail, by disposing the measurement electrode for capacitance measurement so as to be opposed to the common electrode with the piezoelectric plates in between and to be opposed to a plurality of ink pressurizing chambers, the capacitance of the piezoelectric plates between the common electrode and the measurement electrode is measured with an area larger than when the measurement electrode is provided for each ink pressurizing chamber, and the temperature of the piezoelectric plates is calculated from the measured capacitance based on the capacitance-temperature characteristic of the piezoelectric plate. The voltage applied to the individual electrodes is changed according to the calculated temperature, and a pressure corresponding to the ink viscosity dependent on the temperature is applied to the ink in the ink pressurizing chambers. Consequently, the temperature change of the entire printer head can be accurately measured.

Moreover, the measurement electrode is disposed so as to be opposed to all the ink pressurizing chambers, and the capacitance of the piezoelectric plates between the common electrode and the measurement electrode is measured with an area larger than when the measurement electrode is provided for each ink pressurizing chamber. Consequently, the temperature can be more accurately measured, so that an optimum voltage can be applied to the piezoelectric plates. Moreover, since the structure can be simplified, the wiring area is hardly increased by the wiring for the measurement electrode, so that the printer head can be prevented from being increased in size.

Moreover, a plurality of ink pressurizing chamber groups each comprising a plurality of ink pressurizing chambers are provided, a plurality of measurement electrodes are provided so as to correspond to the ink pressurizing chamber groups respectively, and measurement is performed for a plurality of measurement areas. For example, a plurality of ink pressurizing chambers are grouped into ink pressurizing chamber groups for the colors of ink, the measurement electrode is provided so as to correspond to each ink pressurizing chamber group, the temperature of each color of ink is measured and a voltage suitable for the temperature of each color of ink is applied. Consequently, even when color printing is performed after monochrome printing is continuously performed, a voltage suitable for the ink viscosity can be applied by performing temperature measurement for each color.

Moreover the order of lamination of the piezoelectric plates, the common electrode and the measurement electrode is such that the layers are arranged symmetrically from the center to both sides in the lamination direction. Consequently, the stress caused by the difference in expansion rate between the materials due to a temperature change can be made the same in both directions in the lamination direction, so that no warp occurs on the piezoelectric plates in the manufacturing process and the rate of occurrence of defects can be reduced.

Moreover, when four piezoelectric plates are laminated, the measurement electrode is disposed between the first and the second piezoelectric plates and the common electrode is disposed between the third and the fourth piezoelectric plates so that the order of lamination of the piezoelectric plates, the common electrode and the measurement electrode is such that the layers are arranged symmetrically from the center to both sides in the lamination direction. Consequently, the stress caused by the difference in expansion rate between the materials due to a temperature change can be made the same in both directions in the lamination direction, whereby no warp occurs on the piezoelectric plates in the manufacturing process and the rate of occurrence of defects can be reduced.

Moreover, when four piezoelectric plates are laminated, the measurement electrode is disposed between the second and the third piezoelectric plates and the common electrode is disposed between the first and the second piezoelectric plates and between the third and the fourth piezoelectric plates so that the order of lamination of the piezoelectric plates, the common electrode and the measurement electrode is such that the layers are arranged symmetrically from the center to both sides in the lamination direction. Consequently, since the stress caused by the difference in expansion rate between the materials due to a temperature change can be made the same in both directions in the lamination direction, no warp occurs on the piezoelectric plates in the manufacturing process and the rate of occurrence of defects can be reduced. Moreover, since the capacitance is more accurately measured by doubling the measurement area by providing two common electrodes and the capacitance is more accurately measured by decreasing the distance between the common electrode and the measurement electrode, the temperature can be accurately measured.

Moreover, three piezoelectric plates are laminated, the measurement electrode is disposed between the first and the second piezoelectric plates, and the common electrode is disposed between the second and the third piezoelectric plates, whereby the structure is simplified. Moreover, the order of lamination of the piezoelectric plates, the common electrode and the measurement electrode is such that the layers are arranged symmetrically from the center to both sides in the lamination direction and the stress caused by the difference in expansion rate between the materials due to a temperature change can be made the same in both directions in the plates in the manufacturing process and the rate of occurrence of defects can be reduced.

Moreover, the thicknesses of all the piezoelectric plates are the same. Consequently, since it is unnecessary to manufacture a plurality of kinds of piezoelectric plates and it is necessary only to manufacture the same piezoelectric plates, the manufacturing process can be simplified, so that the manufacturing cost can be reduced.

Moreover, the piezoelectric plates sandwiched between the common electrode and the measurement electrode are thinner than the other piezoelectric plates. Consequently, even if the electrode area is the same, the measured capacitance is increased, the capacitance is accurately measured, and the temperature can be accurately measured.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An ink-jet printer head comprising:

a board where a plurality of ink pressurizing chambers are formed;

a plurality of piezoelectric plates laminated on the board;

a common electrode and a plurality of individual electrodes that are opposed to each other with the piezoelectric plates in between, said common electrode being disposed over the ink pressurizing chambers, said individual electrodes being disposed so as to correspond to the ink pressurizing chambers respectively; and a measurement electrode that is opposed to the common electrode with the piezoelectric plates in between and measures capacitance with the common electrode, said measurement electrode being disposed so as to be opposed to the ink pressurizing chambers, wherein the measurement electrode is disposed so as to be opposed to all the ink pressurizing chambers.

2. The ink-jet printer head according to claim 1, wherein on the board, the piezoelectric plates, the common electrode and the measurement electrode are laminated in an order such that layers are arranged symmetrically from a center to both sides in a lamination direction.

3. The ink-jet printer head according to claim 1, wherein on the board, a first, a second, a third and a fourth piezoelectric plates are laminated in this order, the measurement electrode is disposed between the first piezoelectric plate and the second piezoelectric plate, the common electrode is disposed between the third piezoelectric plate and the fourth piezoelectric plate, and on an outer surface of the fourth piezoelectric plate, the individual electrodes are disposed so as to be opposed to the ink pressurizing chambers formed on the board.

4. The ink-jet printer head according to claim 1, wherein on the board, a first, a second, a third and a fourth piezoelectric plates are laminated in this order, the measurement electrode is disposed between the second piezoelectric plate and the third piezoelectric plate, the common electrode is disposed between the first piezoelectric plate and the second piezoelectric plate and between the third piezoelectric plate and the fourth piezoelectric plate, and on an outer surface of the fourth piezoelectric plate, the individual electrodes are disposed so as to be opposed to the ink pressurizing chambers formed on the board.

5. The ink-jet printer head according to claim 1, wherein on the board, a first, a second and a third piezoelectric plates are laminated in this order, the measurement electrode is disposed between the first piezoelectric plate and the second piezoelectric plate, the common electrode is disposed between the second piezoelectric plate and the third piezoelectric plate, and on an outer surface of the third piezoelectric plate, the individual electrodes are disposed so as to be opposed to the ink pressurizing chambers formed on the board.

6. The ink-jet printer head according to claim 1, wherein the piezoelectric plates all have a same thickness.

7. The ink-jet printer head according to claim 1, wherein the piezoelectric plate sandwiched between the common electrode and the measurement electrode is thinner than the other piezoelectric plates.

8. An ink-jet printer head comprising:

a board where a plurality of ink pressurizing chambers are formed;

a plurality of piezoelectric plates laminated on the board;

a common electrode and a plurality of individual electrodes that are opposed to each other with the piezoelectric plates in between, said common electrode being disposed over the ink pressurizing chambers, said individual electrodes being disposed so as to correspond to the ink pressurizing chambers respectively; and a measurement electrode that is opposed to the common electrode with the piezoelectric plates in between and measures capacitance with the common electrode, said measurement electrode being disposed so as to be opposed to the ink pressurizing chambers, wherein the measurement electrode is provided in a plurality of numbers, and has a plurality of ink pressurizing chamber groups each comprising more than one of the ink pressurizing chambers, and the measurement electrodes are disposed so as to correspond to the ink pressurizing chamber groups, respectively.

9. The ink-jet printer head according to claim 8, wherein the ink pressurizing chambers constituting the ink pressurizing chamber group are communicated each other by an ink flow path respectively.

10. The ink-jet printer head according to claim 8, wherein on the board, the piezoelectric plates, the common electrode and the measurement electrode are laminated in an order such that layers are arranged symmetrically from a center to both sides in a lamination direction.

11. The ink-jet printer head according to claim 8, wherein on the board, a first, a second, a third and a fourth piezoelectric plates are laminated in this order, the measurement electrode is disposed between the first piezoelectric plate and the second piezoelectric plate, the common electrode is disposed between the third piezoelectric plate and the fourth piezoelectric plate, and on an outer surface of the fourth piezoelectric plate, the individual electrodes are disposed so as to be opposed to the ink pressurizing chambers formed on the board.

12. The ink-jet printer head according to claim 8, wherein on the board, a first, a second, a third and a fourth piezoelectric plates are laminated in this order, the measurement electrode is disposed between the second piezoelectric plate and the third piezoelectric plate, the common electrode is disposed between the first piezoelectric plate and the second piezoelectric plate and between the third piezoelectric plate and the fourth piezoelectric plate, and on an outer surface of the fourth piezoelectric plate, the individual electrodes are disposed so as to be opposed to the ink pressurizing chambers formed on the board.

13. The ink-jet printer head according to claim 8, wherein on the board, a first, a second and a third piezoelectric plates are laminated in this order, the measurement electrode is disposed between the first piezoelectric plate and the second piezoelectric plate, the common electrode is disposed between the second piezoelectric plate and the third piezoelectric plate, and on an outer surface of the third piezoelectric plate, the individual electrodes are disposed so as to be opposed to the ink pressurizing chambers formed on the board.

14. The ink-jet printer head according to claim 8, wherein the piezoelectric plates all have a same thickness.

15. The ink-jet printer head according to claim 8, wherein the piezoelectric plate sandwiched between the common electrode and the measurement electrode is thinner than the other piezoelectric plates.

16. A piezoelectric actuator having a plurality of displacement portions, comprising;

a plurality of laminated piezoelectric plates;

a common electrode and a plurality of individual electrodes that are opposed to each other with the piezoelectric plates in between, said common electrode being disposed over the displacement portions, said individual electrodes being disposed so as to correspond to the displacement portions respectively; and a measurement electrode that is opposed to the common electrode with the piezoelectric plates in between and measures capacitance with the common electrode, said measurement electrode being disposed over the displacement portions and having substantially the same configuration and area as the common electrode.

* * * * *